US010166660B2

(12) United States Patent
Chen et al.

(10) Patent No.: US 10,166,660 B2
(45) Date of Patent: Jan. 1, 2019

(54) SCREW LOCKING CONTROL SYSTEM AND OPERATING SYSTEM USING THE SAME

(71) Applicant: Universal Scientific Industrial (Shanghai) Co., Ltd., Shanghai (TW)

(72) Inventors: Hsin-Shun Chen, Nantou County (TW); Kuo-Pin Tseng, Nantou County (TW); Jen-Chu Huang, Nantou County (TW); Chih-Li Lo, Nantou County (TW); Yung-Chien Lin, Nantou County (TW); Kuang-Wei Chuang, Nantou County (TW); Jun Song, Shanghai (CN); Wei Wang, Shanghai (CN)

(73) Assignee: UNIVERSAL SCIENTIFIC INDUSTRIAL (SHANGHAI) CO., LTD., Shanghai (CN)

( * ) Notice: Subject to any disclaimer, the term of this patent is extended or adjusted under 35 U.S.C. 154(b) by 826 days.

(21) Appl. No.: 14/627,481

(22) Filed: Feb. 20, 2015

(65) Prior Publication Data

US 2016/0167206 A1 Jun. 16, 2016

(30) Foreign Application Priority Data

Dec. 12, 2014 (CN) ..... 2014 1 0767129

(51) Int. Cl.
*B25B 23/147* (2006.01)
*B25B 21/00* (2006.01)

(52) U.S. Cl.
CPC ..... *B25B 23/147* (2013.01); *B25B 21/00* (2013.01)

(58) Field of Classification Search
CPC .... B25B 21/00; B25B 23/147; B25B 23/1425
USPC ..... 173/1, 5, 7
See application file for complete search history.

(56) References Cited

U.S. PATENT DOCUMENTS 6,668,212 B2 * 12/2003 Colangelo, III ..... B25B 23/145 173/5
7,182,147 B2 * 2/2007 Cutler ..... B25B 21/00 173/1
7,556,103 B2 * 7/2009 Matsunaga ..... B25B 23/147 173/176
7,726,412 B2 * 6/2010 Matsunaga ..... B25B 23/141 173/176
7,954,557 B2 * 6/2011 Cutler ..... B25B 21/00 173/1
9,776,453 B2 * 10/2017 Fujimoto ..... B60B 29/006
(Continued)

*Primary Examiner* — Andrew M Tecco
(74) *Attorney, Agent, or Firm* — Muncy, Geissler, Olds & Lowe, P.C.

(57) ABSTRACT

A screw locking control system includes a host, a control unit controlled by the host, an electric screw driver and a holder. The control unit includes a processor, a voltage detecting module, a power outlet for providing electricity to the electric screw driver, and a lighting signal control module electrically connected to a plurality of indicator lamps of the holder. As a result, the control unit can turn on the indicator lamps sequentially via the light signal control module, guiding operators to carry out each screw locking operation and detecting a voltage variance of the electric screw driver to determine whether each screw locking operation is qualified. Thus, the quality of the manufacturing process is consistently maintained.

3 Claims, 2 Drawing Sheets

(56) References Cited

U.S. PATENT DOCUMENTS

| | | | | |
|---|---|---|---|---|
| 2008/0230245 | A1* | 9/2008 | Matsunaga | B25B 23/147 173/4 |
| 2011/0278037 | A1* | 11/2011 | Cutler | B25B 21/00 173/176 |
| 2012/0234569 | A1* | 9/2012 | Lawton | B25B 21/00 173/181 |
| 2015/0122521 | A1* | 5/2015 | Chen | B25F 5/001 173/1 |
| 2015/0122522 | A1* | 5/2015 | Fujimoto | B60B 29/006 173/1 |
| 2015/0273671 | A1* | 10/2015 | Totsu | B25B 21/00 173/178 |

* cited by examiner

SCREW LOCKING CONTROL SYSTEM AND OPERATING SYSTEM USING THE SAME

BACKGROUND OF THE INVENTION

1. Field of the Invention

The present disclosure relates generally to a screw locking apparatus, and more particularly, to a screw locking control system and an operating method thereof which guide a user in a screw locking operation by lighting signals and determine the results of each screw locking operation by means of detecting the voltage difference of the electric screw driver, enhancing the quality of each screw locking operation.

2. Description of the Related Art

Nowadays, screw locking apparatus is extensively applied to industrial production. Screw locking operation is a repeated and tedious work such that errors occur easily due to the carelessness of user and it results in the decreasing of the yield rate. To deal with the aforementioned problem, various screw counters and screw locking error detectors are provided in the market to decrease the occurrence of insufficient or incomplete screw locking problems. However, conventional screw locking apparatuses are usually equipped with its exclusive electric screw drivers. If single product requires using different types of screws such that the corresponding electric screw drivers are needed in the screw locking operation, it is inevitable to use more screw locking apparatuses to cope with the aforesaid situation, thus soaring the total equipment cost of the screw locking apparatuses.

Besides, the operating modes of the conventional screw locking apparatus still depend on user's personal preference. The problem of insufficient screw locking can not be effectively avoided.

SUMMARY OF THE INVENTION

To solve the aforesaid problem, a screw locking control system is provided. It includes a host, a control unit, an electric screw driver, and a holder. The control unit is electrically connected to the host and controlled by the host. The control unit includes a processor, a voltage detecting module electrically connected to the processor, a power outlet electrically connected to the voltage detecting module and providing electricity to the electric screw driver, and a lighting signal control module electrically connected to the processor. The holder includes a plurality of indicator lamps which are electrically connected to the lighting signal control module, and the indicator lamps are controlled and turned on sequentially by the lighting signal control module.

As a result, the screw locking control system of the present disclosure can be applied to different brand's electric screw drivers and provide lighting signals to remind the user before each screw locking operation. Hence, the yield rate of each screw locking operation in the present disclosure can be effectively enhanced and the equipment cost can be decreased.

Moreover, an operation method of the screw locking control system is provided in the present disclosure. It includes steps of: a) the host transmitting a setting data of each screw locking operation to the control unit; b) the control unit sequentially turning on the indicator lamps according to the setting data via the lighting signal control module, and using the electric screw driver sequentially performing the screw locking operation, The voltage detecting module detecting a voltage difference of the electric screw driver in each screw locking operation to determine whether each screw locking operation is qualified; and c) the control unit transmitting the results of the aforesaid screw locking operations to the host and displaying the results.

As a result, the user can understand the results of each screw locking operation via the host. The host further can send the results to a Shop Floor Integrated System (SFIS) to do the monitoring and the management of the entire manufacturing process.

DETAILED DESCRIPTION OF EMBODIMENTS

Figure 1:
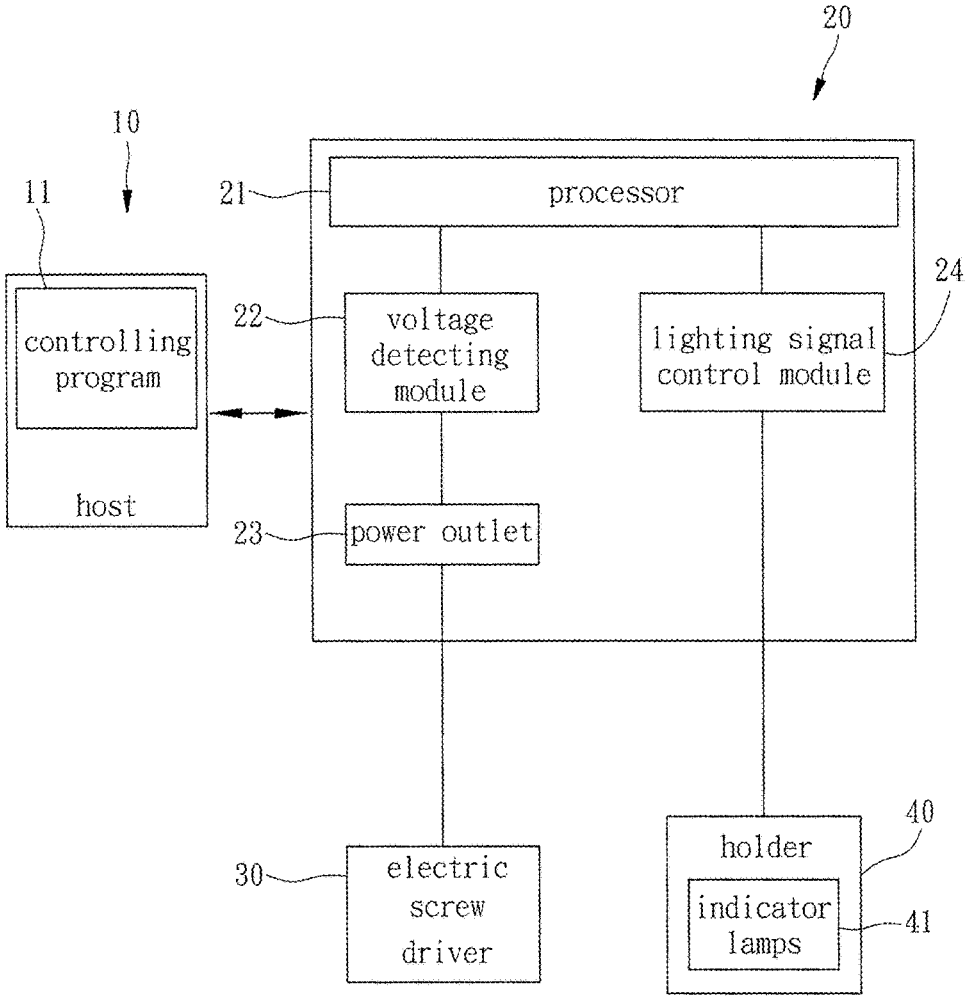
FIG. 1 is a schematic diagram of a screw locking control system of the present disclosure.

To better understand the present invention, an exemplary embodiment and the accompanying drawings are provided below. Please refer to FIG. 1. The screw locking control system includes a host 10, a control unit 20 connected to the host 10 via an USB (universal Serial Bus) connector, an electric screw driver 30, and a holder 40. The electric screw driver 30 and the holder 40 are electrically connected to the control unit 20.

The host 10 is an information processing apparatus which stores a controlling program 11 for providing a function menu of screw locking operation settings, screw locking state examination, screw locking state display and the corresponding screen images respectively. The host 10 further can be connected to a Shop Floor Integrated System (SFIS) to process a flow process monitoring.

The control unit 20 includes a processor 21 electrically connected to a voltage detecting module 22 and a lighting signal control module 24. The voltage detecting module 22 is electrically connected to a power outlet 23 for providing electricity to the electric screw driver 30. The lighting signal control module 24 is electrically connected to the holder 40. The processor 21 receives a setting data of each screw locking operation from the host 10 to control the lighting signal control module 24. The quantity of the power outlet 23 may be increased as needed. The voltage detecting module 22 detects the voltage variance of the electric screw driver 30 via the power outlet 23 when the electric screw driver 30 is turned on and turned off, and then transmits the voltage variance data to the processor 21 to define an actual screw locking time interval of each screw locking operation. After that, the processor 21 sends the aforesaid data to the host 10.

The holder 40 is capable of mounting a product which is to be screw locked (not shown in the drawings). The holder 40 is provided with a plurality of indicator lamps 41 corresponding to each screw hole of the product to be screw locked. The indicator lamps 41 used in the present exemplary embodiment are light-emitting diodes (LEDs), which are turned on one by one under the control of the lighting signal control module 24.

As a result, the lighting signal control module 24 facilities guiding users to operate the electric screw driver 30 to perform each screw locking operation by means of the indicator lamps 41. Thus, the screw locking control system can be applied to different brands and types of the electric screw drivers 30.

Figure 2:
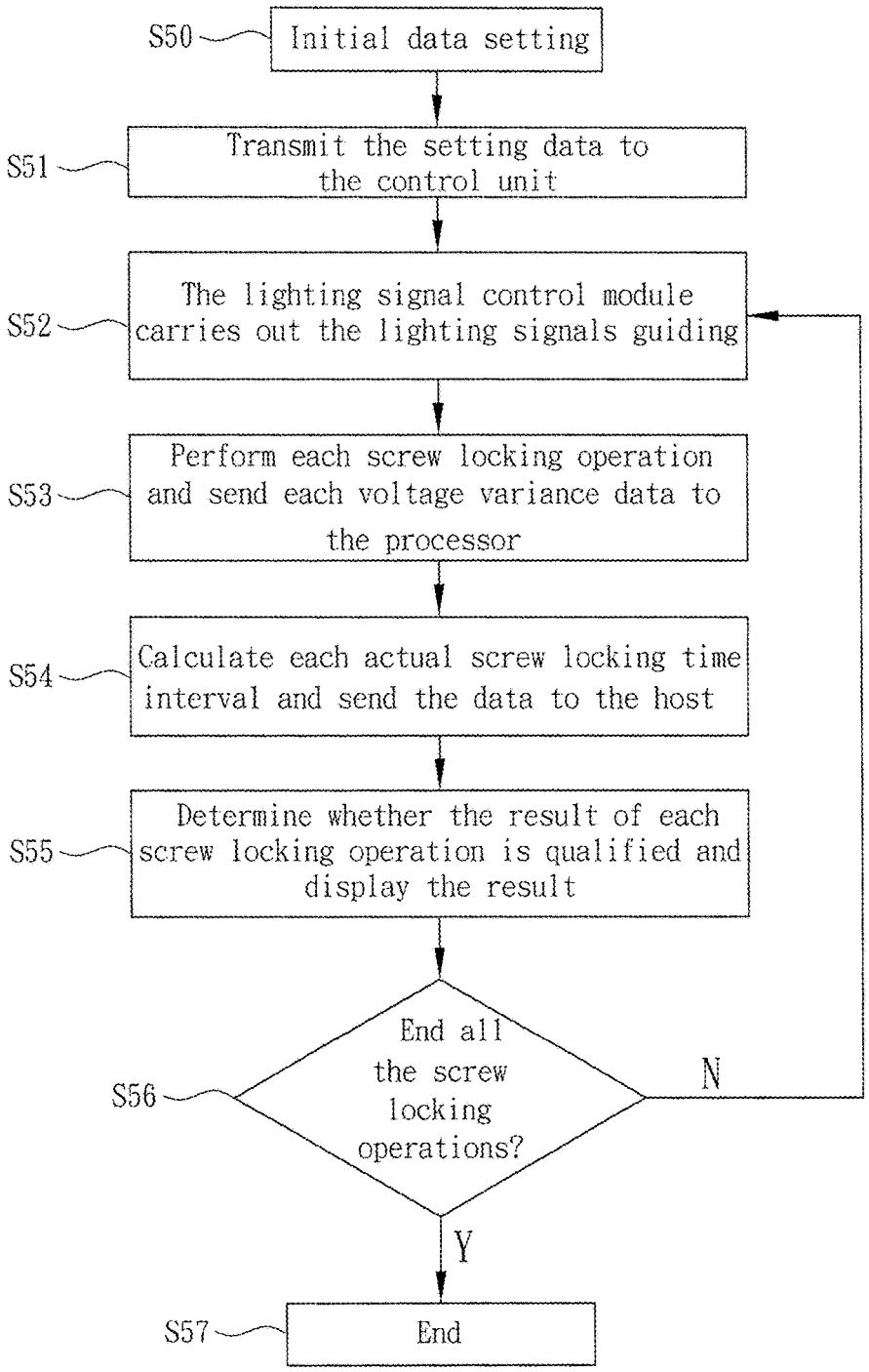
FIG. 2 is a flow chart of an operating method of the screw locking control system.

The detailed operating method of the screw locking control system of the present disclosure is set forth below. Please refer to FIG. 2. First, in step S50 the user performs an initial data setting process which includes setting a locking order of each screw, then performing a preliminary operation of each screw locking operation according to the locking order and calculating a locking time interval of each screw by each voltage variance of the electric driver 30 when performing each screw locking operation, and sending each aforesaid locking time interval to the host 10 to define a preset screw locking time interval of each screw. Moreover, the initial data setting process may also include setting user's ID, user's password, apparatus ID number, assembling station ID number, screw type, and screw quantity.

After finishing the initial data setting process, step S51 is performed to transmit the aforesaid setting data in step S50 to the processor 21 of the control unit 20 via the USB (universal Serial Bus) connector. After step S51, the processor 21 transmits the data of the lighting order and the corresponding screw locking position in step S52 to the lighting signal control module 24 to control the indicator lamps 41 of the holder 40 to guide the user to operate the electric screw driver 30. Then, perform step S53. The user operates the electric screw driver 30 to perform each screw locking operation according to the aforesaid lighting order. In the meanwhile, the voltage detecting module 22 detects each voltage variance of the electric screw driver 30 when it is turned on and turned off, and sends each voltage variance data to the processor 21.

After the processor 21 receives the aforesaid voltage variance data, step S54 is performed. The processor 21 calculates each actual screw locking time interval by the aforesaid voltage variance data, and then sends each actual screw locking time interval to the host 10.

After the host 10 receives the actual screw locking time interval data from the processor 21, step S55 is performed. The host 10 compares the actual screw locking time interval and the preset screw locking time interval to determine whether each screw locking operation is qualified. The results of the comparisons will be classified into "Pass" or "Fail" and displayed in a monitor of the host 10. It is noted that the criterion of the aforesaid classification may depend on a preset tolerance time (e.g. 1 second) which is set by the user beforehand. If the time difference between the actual screw locking time interval and the preset screw locking time interval is less than the aforesaid preset tolerance time, the result of the comparison will be "Pass", otherwise the result will be "Fail".

Finally, step S56 is performed. The host 10 determines whether end all the screw locking operations (e.g. the total number of the products to be screw locked is reached). If the result is not ending the screw locking operation, then return to step S52 and continue another screw locking operation, otherwise perform step S57 and end all the process.

In conclusion, the screw locking control system of the present disclosure can guide the user via the indicator lamps 41 to prevent the user from mistakenly performing each screw locking operation, thus enhancing the quality of each screw locking operation.

It should be understood that the detailed description and specific example, while indicating preferred embodiment of the invention, are given by way of illustration only, and thus are not limitative of the present invention. The invention being thus described, it will be obvious that the same may be varied in many ways. Such variances are not to be regarded as a departure from the spirit and scope of the invention, and all such modifications as would be obvious to one skilled in the art are intended to be included within the scope of the following claims.

What is claimed is:

1. An operating method for a screw locking control system, the screw locking control system comprising a host, a control unit, an electric screw driver and a holder, the control unit having a processor, a voltage detecting module, a power outlet electrically connected to the voltage detecting module, and a lighting signal control module, the processor being controlled by the host and electrically connected to the host, the voltage detecting module, and the lighting signal control module, the electric screw driver electrically connected to the power outlet, the holder having a plurality of indicator lamps electrically connected to the lighting signal control module, the holder being capable of mounting a product which is to be screw locked, the plurality of indicator lamps corresponding to each screw hole of the product to be screw locked, the indicator lamps being controlled and turned on sequentially by the lighting signal control module, the operating system comprising the steps of:

a) the host transmitting a setting data of each screw locking operation to the control unit;

b) the control unit sequentially turning on the indicator lamps according to the setting data via the lighting signal control module and the electric screw driver sequentially performing each screw locking operation, the voltage detecting module detecting a voltage variance of the electric screw driver in each screw locking operation to determine whether each screw locking operation is qualified; and c) the control unit transmitting the results of each screw locking operation to the host and displaying the results, wherein step a) further comprises an initial data setting operation, which comprises setting a locking order first, performing each screw locking operation according to the locking order, and sending the results of each voltage variance to the host to define a preset screw locking time interval of each screw, and wherein in step b) the voltage detecting module detects the voltage variance of the electric screw driver when the electric screw driver is turned on and turned off to define an actual screw locking time interval; the host compares the actual screw locking time interval and the preset screw locking time interval to determine whether each screw locking operation is qualified.

2. The operating method as claimed in claim 1, wherein in step b) using a preset tolerance time; if a time difference between the actual screw locking time interval and the preset screw locking time interval is less than the preset tolerance time, the result of the screw locking operation is passed, otherwise the result of the screw locking operation is failed.

3. The operating method as claimed in claim 1, further comprises step d): the host determining whether end the screw locking operation; if the result is false, return to step b), otherwise end the screw locking operation.

* * * * *